US007293614B2

(12) United States Patent
Rose

(10) Patent No.: US 7,293,614 B2
(45) Date of Patent: Nov. 13, 2007

(54) MULTIPLE IMPACT JAR ASSEMBLY AND METHOD

(75) Inventor: Lawrence C. Rose, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 374 days.

(21) Appl. No.: 10/942,700

(22) Filed: Sep. 16, 2004

(65) Prior Publication Data

US 2006/0054322 A1 Mar. 16, 2006

(51) Int. Cl.
*E21B 4/14* (2006.01)
*E21B 4/06* (2006.01)

(52) U.S. Cl. ..... 175/57; 175/296; 175/304; 166/178

(58) Field of Classification Search ..... 175/296, 175/297, 304, 57; 166/178
See application file for complete search history.

(56) References Cited

U.S. PATENT DOCUMENTS

| | | | | |
|---|---|---|---|---|
| 3,399,741 | A * | 9/1968 | Monroe | 175/297 |
| 3,570,611 | A | 3/1971 | Riziuc et al. | |
| 3,987,858 | A | 10/1976 | Slator et al. | |
| 4,109,736 | A | 8/1978 | Webb et al. | |
| 4,200,158 | A | 4/1980 | Perkins | |
| 4,226,289 | A | 10/1980 | Webb et al. | |
| 4,478,284 | A | 10/1984 | Tomm et al. | |
| 4,807,709 | A | 2/1989 | Falgout, Sr. et al. | |
| 5,503,228 | A * | 4/1996 | Anderson | 166/301 |
| 5,595,253 | A * | 1/1997 | Martin et al. | 175/297 |
| 5,647,446 | A * | 7/1997 | Wenzel | 175/297 |
| 5,918,689 | A * | 7/1999 | Roberts | 175/297 |
| 6,164,393 | A | 12/2000 | Bakke | |
| 6,206,101 | B1 | 3/2001 | Bakke | |
| 6,290,004 | B1 | 9/2001 | Evans | |
| 6,655,460 | B2 * | 12/2003 | Bailey et al. | 166/301 |
| 7,066,263 | B1 * | 6/2006 | Mouton | 166/301 |
| 2001/0018974 | A1 * | 9/2001 | Mouton et al. | 166/301 |
| 2005/0230101 | A1 * | 10/2005 | Zheng et al. | 166/177.6 |

* cited by examiner

*Primary Examiner*—Jennifer H. Gay
*Assistant Examiner*—Shane Bomar
(74) *Attorney, Agent, or Firm*—Browning Bushman P.C.

(57) ABSTRACT

A hydraulic jarring tool may be suspended in a well from a wireline, tubular string or drill string, and may be activated to release a tool stuck in the well, or to release the drill string. Each of an upper and lower jarring section include a housing, a piston, a piston biasing member, a fluid metering device and a release mechanism for holding an hammer in a downward position and releasing the hammer to strike an anvil in response to movement of the piston. A timing mechanism results in a timed delay between the impact of one hammer striking the anvil and the other hammer striking the anvil.

38 Claims, 4 Drawing Sheets

MULTIPLE IMPACT JAR ASSEMBLY AND METHOD

FIELD OF THE INVENTION

The present invention relates to downhole jars conventionally used in hydrocarbon recovery operations to break free a tool or a drill string stuck in a well. More particularly, this invention relates to a multiple impact hydraulic jar assembly capable of producing two or more jarring actions in the same axial direction with a selected short time delay between the jarring action. The timing between the impact of one jar section and the impact of another jar section is controlled to achieve a significant impulse.

BACKGROUND OF THE INVENTION

Various types of jars have been used commercially during drilling and logging operations. Mechanically actuated jars have been used for decades in downhole operations to break loose a tool struck in a well. A mechanically actuated jar may be suspended in a well from a wireline, and utilizes two energy sources for the jarring effect: (1) stored energy within springs within the tool; and (2) the wireline acting like a spring. Both sources of energy may be released when tension reaches a selected level. Stronger grades of wireline have been introduced recently with breaking strength up to 28,000 pounds. The stronger wireline and wireline connectors mean operators can pull harder from the surface to free logging tools stuck downhole.

A wireline hydraulic jar also utilizes the stored energy of a spring to produce part of an impact, but relies primarily upon metering fluid through an orifice in the tool in order to release a mass which creates the jarring force. Hydraulic jars have also been used in the past with an enhancer, which is basically an inverted hydraulic jar with its own set of springs and no hammer release mechanism. A hydraulic jar can become more effective with the additional mass of both the jar and the enhancer. A mechanical jar relies primarily on the impact (initial hit) of the jar, but does deliver both an impact and a short impulse. Mechanical jars have proven to be maintenance intensive, and are not widely favored compared to hydraulic jars. Hydraulic jar components are effectively sealed within a housing from downhole fluids, and thus have a high reliability and less maintenance. A significant advantage to the hydraulic jar is its timed release capacity, which allows the operator to make a variable pull and therefore achieve a maximum pull with maximum impact.

When a jar is activated, impact is the initial instantaneous force generated by the jar. Impulse is a residual force of the impact, consisting of reverberations occurring in milliseconds following an activation. The objective of a jar is to create the strongest impact possible and the strongest and longest impulse. The impact of a mechanical jar is preselected value before running the jar in the hole. The selected value cannot be changed unless the tool is retrieved to the surface. A hydraulic jar, on the other hand, can vary the jarring force by varying the pull exerted on the wireline while fluid is metered past the piston. A hydraulic jar may therefore produce a significantly greater impact and a significant impulse compared to a mechanical jar.

Operators have commonly used jars in the past when a tool or drill string becomes stuck in a well. Tools which frequently become stuck in the hole include formation testers, density/neutron tools and resistivity tools. More recently, operators are requesting the inclusion of a jar when tools or drill strings which are susceptible to becoming lodged in a well are used, so that the jar will already be in place if the tool or drill string becomes stuck in the well. The benefits of using a wireline instrument to log oil and gas wells quickly diminishes if the logging string frequently becomes stuck in the well. As wells become deeper with more complex well designs, improved jarring tools are required to ensure that these logging tools can be retrieved successfully. A drill string stuck in a well may cost an operator hundreds of thousands of dollars to free. It is now even more important to run the jars with the logging tool or drill string since freeing a drill string or logging tool typically becomes more difficult the longer the drill string or logging tool is stuck in the well.

U.S. Pat. No. 3,987,858 discloses a hydromechanical drilling jar consisting of a hydraulic jar for an upward jarring motion and a mechanical jar for a downward jarring motion. The release of tension in the drill string contributes to an upward jarring blow when fluid flows around a piston. If the jarring blow does not release the stuck object, a downward jarring will be effected with the mechanical jar section.

U.S. Pat. No. 4,109,736 discloses a double acting hydraulic jar capable of applying an upward jarring action and a separate downward jarring action. U.S. Pat. No. 4,807,709 discloses a fluid activated jar that utilizes drilling fluid to open and close the jar. U.S. Pat. No. 4,226,289 discloses a hydraulic jar capable of being automatically reset to deliver a plurality of jarring motions. The tool is intended to jar up and jar down utilizing the appropriate hydraulic jar section of the tool.

The benefits of a hydraulic jar are discussed in an article entitled "New Jar Technology Minimizes Risks of Unproductive Rig Time in Well Logging Operations." Other patents of interest include U.S. Pat. Nos. 6,290,004, 6,164,393, 6,206,101, 4,478,284, 4,200,158 and 3,570,611.

The disadvantages of prior art are overcome by the present invention. An improved multiple impact hydraulic jar assembly and method are hereinafter disclosed capable of producing two or more jarring actions with a selected short time delay between the jarring actions.

SUMMARY OF THE INVENTION

A hydraulic jarring tool is provided for suspending in a well from one of a wireline, tubular string or drill string. The jarring tool may be used to release a tool stuck in the well, or to release the drill string stuck in the well. In one embodiment, the jarring tool comprises an upper jarring section and a lower jarring section each including a housing having a central axis, a piston axially movable within the housing when tension is applied to one of the wireline, tubular string or drill string, a spring or other biasing member for biasing the piston upward, a fluid metering device for metering fluid within the housing axially past the piston, and a release mechanism for holding a hammer in a downward position relative to an anvil and releasing the hammer to strike an anvil in response to movement of the piston within the housing. A timing mechanism is provided for releasing one of the upper and lower hammers subsequent to releasing the other of the upper and lower hammers, thereby resulting in a timed delay between the impact of one hammer striking the respective anvil and the impact of the other hammer striking the respective anvil.

In one embodiment, the timing mechanism includes an upper fluid metering device metering fluid at a different rate than the lower fluid metering device. In another embodiment, the upper release mechanism has a different axial travel length than the lower release mechanism before releasing the respective hammer, such that one hammer is released prior to the other hammer.

One disadvantage to the metering time in hydraulic jars is that if jarring is required several times repeatedly it can take longer than desired to jar. There may thus be some advantage to reducing the metering time and jarring faster. A feature of an externally selectable switch may be provided for selecting the number of times fluid is metered past one of the upper or lower pistons prior to increasing the flow volume past a respective metering device, thereby reducing the metering time. The selected switch may be activated each time the respective jarring section is activated, thereby providing a visual indication that the jarring section has been activated when the jar assembly is returned to the surface.

As a further feature, the jarring tool may include an enhancer for pulling upward on the tool or drill string stuck in the well, with the enhancer including one or more springs loaded by tension in the wireline, tubular string or drill string and released to exert an upward force. An enhancer may be provided between the upper and lower hydraulic jarring sections, or may be provided above both jarring sections. The enhancer allows the better use of force in the wireline or tubular when a second jar is provided above the enhancer. In one embodiment, this allows the upper jarring section to be activated, the lower jarring section then activated, and the upper jarring section then reactivated before resetting the jarring tool.

According to the method of the invention, an upper jarring section and a lower jarring section are each supported on the wireline, the tubular string or the drill string. An upper piston is provided axially movable within an upper housing when tension is applied to the wireline, the tubular string or the drill string, and similarly a lower piston is axially movable within the lower housing. Each piston is biased upward, preferably by Bellville springs. The method involves metering fluid within each of the upper and lower housings past the respective upper and lower piston, and providing a respective upper and lower release mechanism each for holding a hammer in a downward position and releasing the hammer to strike an anvil in response to movement of the respective piston to produce an upward jarring force. According to the method, one of the upper and lower hammers is released subsequent to releasing the other of the upper and lower hammers, thereby resulting in a timed delay between the impact of one hammer striking the respective anvil and the impact of the other hammer striking the respective anvil.

According to one embodiment, releasing one of the upper and lower hammers includes metering fluid at different rates past the respective upper and lower piston, while in another embodiment releasing one of the upper and lower hammers includes providing a different travel length for the upper and lower release mechanisms before releasing the respective hammer. The method may also involve providing an enhancer for pulling upward on the tool or drill string stuck in the well, with the enhancer being provided above the upper and lower jars or between the upper jar and the lower jar.

According to one embodiment, the selector switch is activated each time a respective one of the upper and lower jars is activated, thereby providing a visual indication that a jarring section has been activated.

A significant advantage is that the hydraulic jarring assembly uses available components. This reduces the cost of the tool and facilitates proper usage by oilfield operators.

These and further features and advantages of the present invention will become apparent from the following detailed description, wherein reference is made to the figures in the accompanying drawings.

DETAILED DESCRIPTION OF PREFERRED EMBODIMENTS

Figure 1:
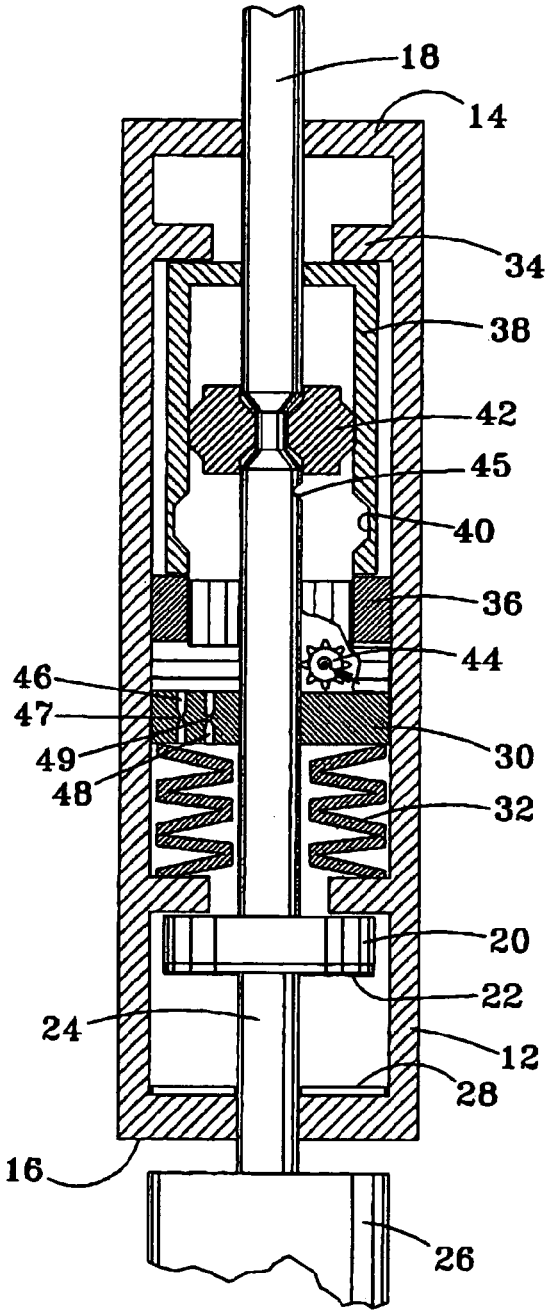
FIG. 1 conceptually illustrates a closed hydraulic jar section.

FIG. 1 simplistically illustrates a hydraulic jarring tool in a closed or pre-actuated position. The jarring tool includes a generally cylindrical housing 12 with a top plate 14 and a bottom plate 16 defining a sealed cavity within the housing. A mandrel 18 is axially moveable within the housing 12 (or more precisely the housing 12 is moveable relative to the mandrel 18 once the mandrel 18 is connected to the tool or drill string stuck in the well), with an anvil 20 supported on the mandrel 18 and having a lower anvil surface 22. A mandrel extension 24 extends downward from the anvil 20. Adaptor 26 at the lower end of mandrel extension 24 may be secured in a conventional manner to the tool or other object stuck in the well. A hammer surface 28 is provided on top of a lower plate 16, and strikes the anvil surface 22 during a jarring action, as explained subsequently.

Piston 30 is also secured to the mandrel 18, and is biased in an upward position by a plurality of springs, preferably Bellville springs 32. Ring 34 at the upper end of housing 12 and ring 36 adjacent to the middle portion of the housing 12 trap a sleeve 38, which includes an annular groove 40 therein. Collet mechanism 42 is supported on the mandrel 18 as shown, and when aligned with the recess 40 allows radial motion of the collet mechanism 42 into the groove or recess 40. Each of the piston 30 and the anvil 20 is secured to the mandrel 18, which moves axially relative to housing 12. The figures and description provided conveniently show the movement of the mandrel 18, although in practice the housing 12 moves upward during actuation of the jar relative to stationary mandrel 18.

FIG. 1 also depicts an indicator or selector switch 44, which preferably includes a portion external to the housing 12 for both viewing and setting by an operator. A upward movement of housing 12 relative to mandrel 18 actuates the switch 44 to indicate that the hydraulic jar has been actuated. The indicator switch 44 thus provides valuable information to the operator when the hydraulic jarring tool is returned to the surface, since the switch visually indicates to the operator the number of times the jar has been activated since it has been downhole. Also, the indicator switch may be set to a selected number of activations, e.g., three activations for a particular jar, at which time the indicator switch may be "zeroed" to either bypass or substantially open the flow metering device discussed below, thereby resulting in the substantially instantaneous activation of the jar without the delay inherent in the selected metering device. Once the indicator switch is zeroed, a plug or cover may thus be removed from a flow path which was partially or totally blocking flow through the piston, or a valve in a flow path across the piston may be opened in response to zeroing of the indicator switch 44.

The piston 30 includes a flow path 46 and a metering device 47 therein for metering fluid from the lower chamber below the piston to the upper chamber above the piston. The piston 30 also includes a flow path 48 and a check valve 49 for allowing fluid above the piston to quickly pass beneath the piston when resetting the jar, as discussed further below.

For the embodiment shown in the drawings, a metering device is placed within a flow path within the piston, so that the metered fluid passes through the piston 30. In many applications, this construction is preferred. In other applications, a metering device could be provided wherein the flow path and a metering device is radially outward on an outer surface of the piston 30, in which case the metered fluid flows axially past but not through the piston.

Figure 2:
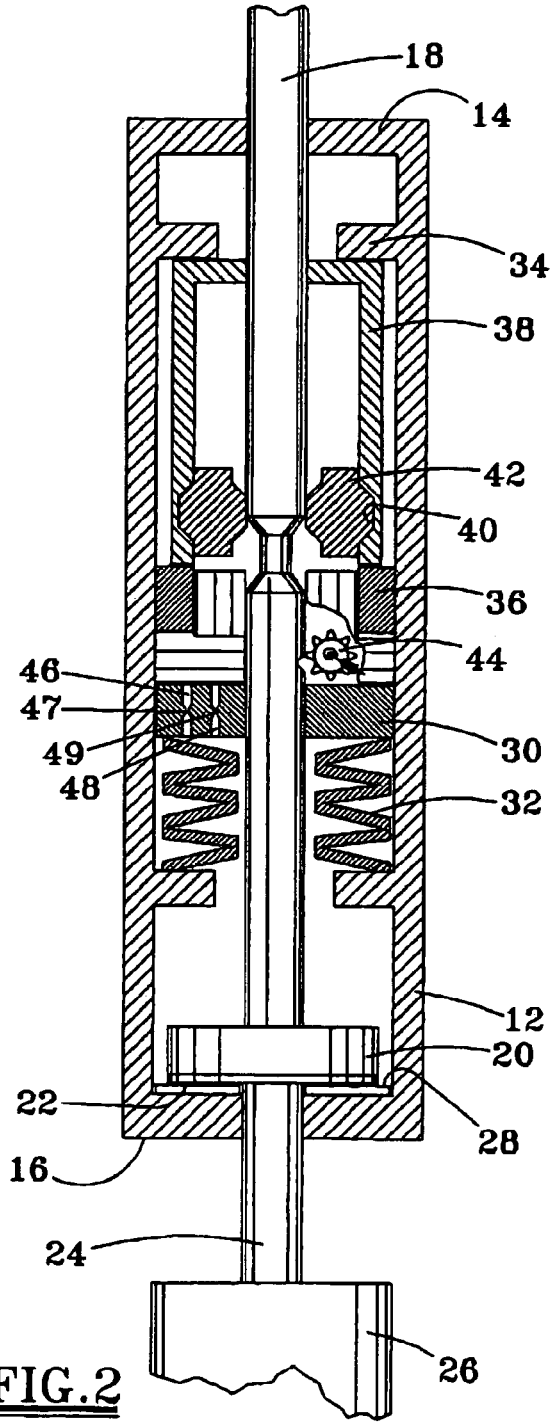
FIG. 2 conceptually illustrates the jar section open to release the jarring force.

FIG. 2 illustrates the jar as shown in FIG. 1 in the actuated position. The housing 12 has thus moved upward relative to the mandrel 18, so that the collets 42 are now positioned within the groove 40, thereby releasing the collets from the mandrel 18, and allowing further movement of the anvil 20 relative to the housing 12. The opening of the hydraulic jar thus causes the hammer surface 28 to strike the anvil surface 22, creating an upward jarring force to release the object stuck in the well.

Figure 3:
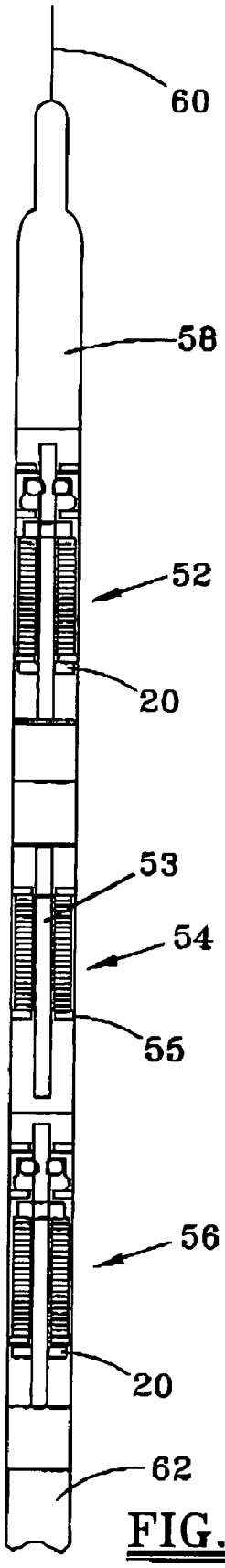
FIG. 3 illustrates one embodiment of a hydraulic jar assembly.

FIG. 3 depicts one embodiment of a jar assembly according to the present invention, wherein the jar assembly includes an upper jar 52, an intermediate enhancer 54, and a lower hydraulic jar 56. Each jar may include the components shown in FIGS. 1 and 2. The upper jar 52 is connected by adaptor 58 to a conventional wireline 60, and the lower jar 56 is connected by lower member 62 to the object stuck in the well. FIG. 3 shows that the upper and lower hydraulic jars in the pre-actuated or closed position, and shows an enhancer 54 with a central mandrel 53 and a plurality of Bellville springs resting on support plate 55 secured to the mandrel 53, as discussed further below.

Figure 4:
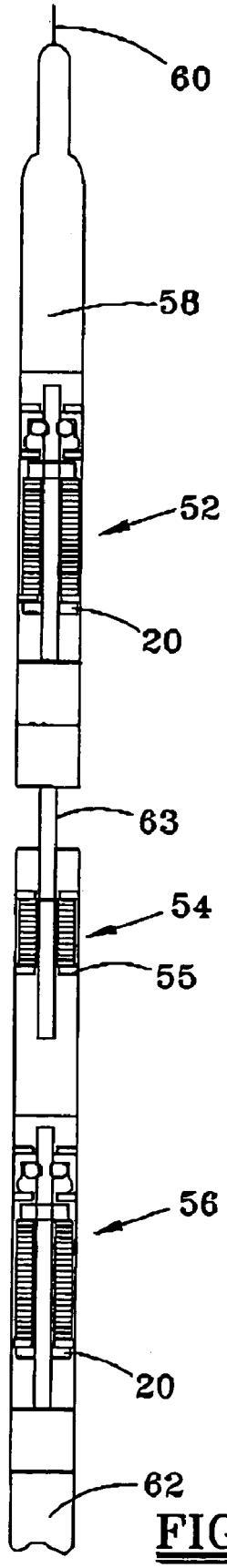
FIG. 4 illustrates the assembly as shown in FIG. 3 with tension applied to the wireline and the enhancer loaded.
Figure 5:
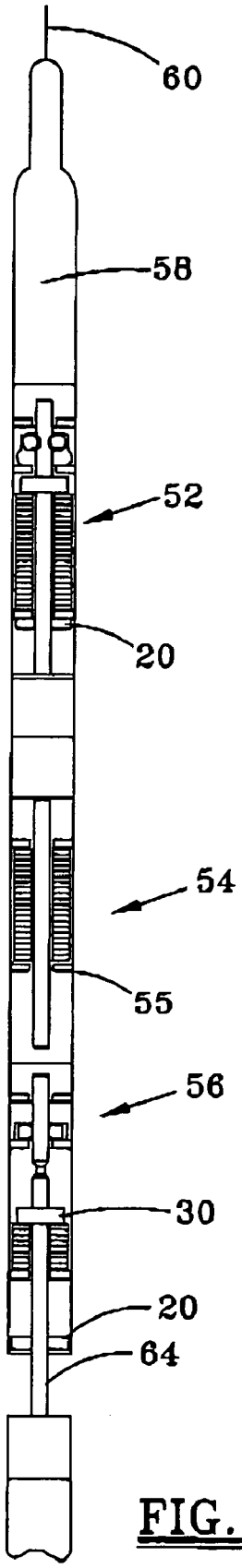
FIG. 5 illustrates the jar as shown in FIG. 4 with the lower jar section activated to close the enhancer.

In FIG. 4, the upward tension of the wireline 62 first opens the enhancer 54, compressing the springs and moving the mandrel 53 upward, thereby creating the gap 63. The continued tension on the wireline 60 would next result in the opening of the lower jar 56, as shown in FIG. 5, thereby closing the enhancer 54 and the previously created gap 63. In the FIG. 5 embodiment, the lower hydraulic jar has thus been actuated, and the anvil 20 is shown in engagement with the hammer.

Figure 6:
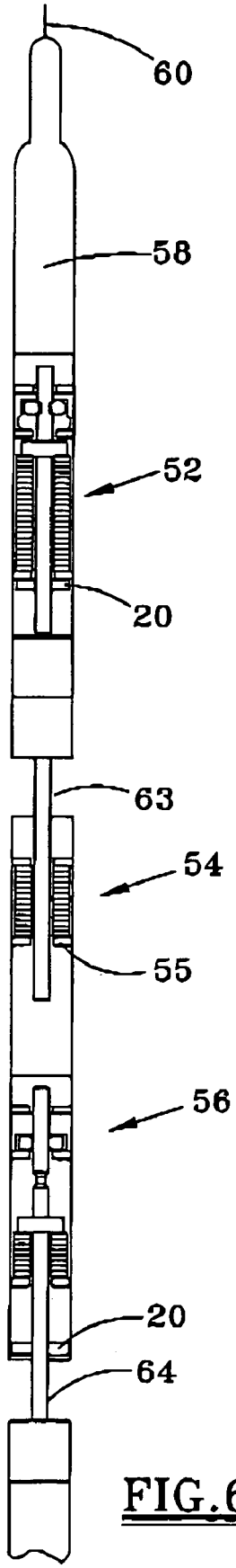
FIG. 6 illustrates the jar as shown in FIG. 5 with the enhancer reopened and loaded.
Figure 7:
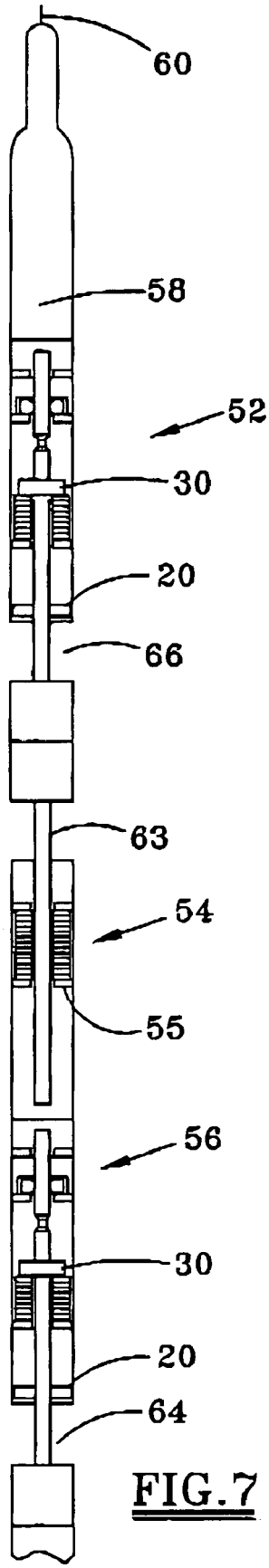
FIG. 7 illustrates the jar assembly as shown in FIG. 6 with the upper jar section activated and the stored energy in the wireline unloaded.

If the tool stuck in the well is not released, further upward pull on the wireline 60 will again move the enhancer 54 to create the gap 63, as shown in FIG. 6, with the lower hydraulic jar 56 remaining open. Finally, FIG. 7 shows the upper jar 52 actuated to create opening 66. Part of the stored energy in the wireline 60 is also unloaded. Thus the lower jar 56 creates a first impact, and the upper jar 52 then creates the second impact. Providing a longer stroke on the upper jar 52 before release of the collets 42 allows one to use the stretch stored in the wireline or tubular.

Figure 8:
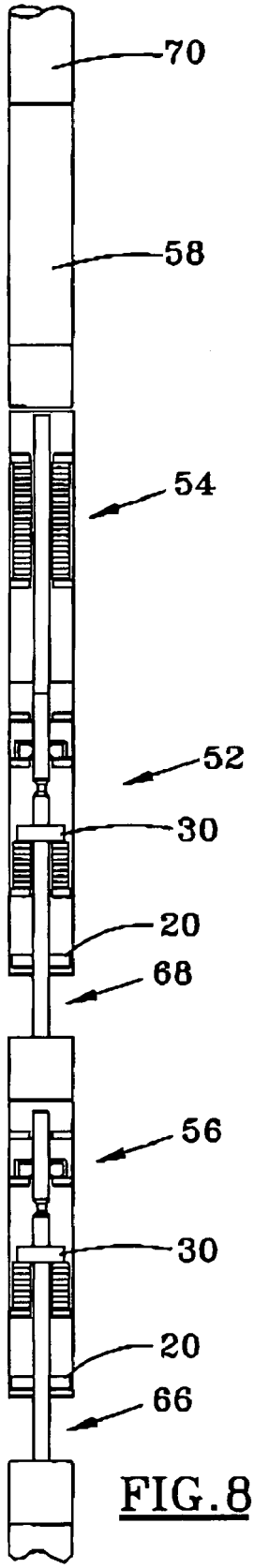
FIG. 8 illustrates another embodiment of the jar assembly positioned on a tubular string, wherein both the upper and lower jar sections are provided below the enhancer. Each jar section is shown activated.

FIG. 8 discloses an alternate embodiment, wherein the upper jar 52 and lower jar 56 are each provided below the enhancer 54. The adaptor 58 in this case connects to a tubular string 70 rather than a wireline. The sequence for operating this tool would first open the enhancer 54, followed by opening of the lower jar 56 and closing of the enhancer 54. The next operation would be the reopening of the enhancer 54, and the last operation as shown in FIG. 8 would involve closing of the enhancer 54 and opening of the upper hydraulic jar 52, thereby creating the opening gap 68. FIG. 8 discloses the assembly positioned on a tubular 70, wherein tension may be applied and released to this tubular in a manner similar to that of a wireline.

Yet another embodiment also includes the upper and lower jars each positioned below the enhancer. In this embodiment, the assembly is suspended in a well from drill pipe 70. In this scenario, the enhancer 54 is first opened, and the upper jar 52 is then opened. The enhancer 54 may then be reopened, followed by opening of the lower jar 56 and then closing the intermediate jar 52. This action then allows reopening of the intermediate jar 52 in which case the enhancer 54 is closed. The benefit of this design is that two jars are used, but three impacts have resulted, a first from the upper jar, a second from the lower jar, and a third from the upper jar.

The hydraulic jarring tool of the present invention may thus be suspended in a well from any one of a wireline, a tubular string or a drill string. A tubular string may also be considered a work string. A drill string inherently is a form of a tubular string, but is separately listed as one of the components for suspending the hydraulic jarring tool in the well since a drill string with a drill bit at the end thereof is commonly one of the components which become stuck in a well and may be released by the hydraulic jarring tool. Each of the upper jarring section and the lower jarring section may thus be supported on a wireline, tubular string or drill string, with a lower jarring section supporting from the upper jarring section, and preferably with an enhancer provided for pulling upward on the tool or drill string stuck in the well. The enhancer conventionally includes one or more springs loaded in tension by the wireline, the tubular string or the drill string and is released to exert an upward force.

According to a preferred embodiment, each jarring section is provided with a release mechanism for holding the respective hammer in a downward position and releasing the hammer to strike the anvil after a length of movement of the piston, thereby producing an upward jarring force. While a collet mechanism is disclosed herein suitable for holding the mandrel in the downward position and releasing the mandrel in response to movement of the piston, other release mechanisms may be provided for holding the hammer in its initial position and releasing the hammer in response to movement of the piston to produce the desired jarring force.

The hydraulic jarring tool also includes a timing mechanism for releasing one of the upper and lower hammers subsequent to releasing the other of the upper and lower hammers, thereby resulting in a timed delay between the impact of one hammer striking the respective anvil and an impact of the other hammer striking the respective anvil. According to one embodiment, the timing mechanism includes the upper fluid metering device which meters fluid a different rate, i.e., at a higher rate or a lower rate, than the lower fluid metering device. In another embodiment, the timing mechanism may be embodied in the release mechanism which has a different travel length for the upper release mechanism compared to the lower release mechanism before releasing the respective hammer, such that one hammer is released prior to the other. Each fluid metering device preferably passes fluid from a lower portion of the respective housing past the respective piston to an upper portion of the respective housing during travel of the piston within the housing.

According to the method of the invention, both an upper jarring section and a lower jarring section are supported on one of a wireline, tubular string or drill string. Each jarring section is provided with a piston axially movable within a respective housing when tension is applied to the wireline, tubular string or drill string, and each piston is biased upward. In response to the tension force, fluid is metered within the respective housing past the piston, thereby releasing a release mechanism which holds a hammer in a downward position and releasing the hammer to strike an anvil in response to movement of the respective piston to produce the upward jarring force. One of the upper and lower hammers is released prior to the other hammer, thereby resulting in a timed delay between the impact of each hammer striking the respective anvil.

The operator may thus set the selector switch at the surface for selecting a number of times fluid is metered past the respective one of the upper and lower pistons prior to substantially increasing flow past the respective piston, and thereby substantially shortening or practically eliminating the delay between the tension on the wireline or work string and actuation of the hydraulic jar. Each time the jar is actuated, the selector switch may indicate the activation, thereby providing a visual indication that the jarring section has been activated. Selector switches may be provided in each of the upper and lower jars. If the operator sets the selector switch on the upper jar for "3" and on the lower jar for "3," the stuck tool with the jar assembly is returned to the surface, and an indication of "1" on each jar will indicate that each jar has been activated two times. If each jar were activated three times, the subsequent activation of each jar may cause the selector switch to open the flow path through or past the piston, so that subsequent activations of the jar may occur substantially simultaneously with the pull of the tension on the wireline or tubular without the delay otherwise caused by the metering device.

After the jar assembly is activated, tension on the wireline or tubular string may be relaxed, thereby allowing the biasing member to bias each piston back to the upper position within its respective housing and resetting the release mechanism. During this operation, fluid may flow from an upper portion of each housing through the flow path 48 and past the check valve 49 to a lower portion of the housing. When each release mechanism is in the set position, the process may be repeated to exert a subsequent jarring force on the tool or drill string struck in the well.

The hydraulic jarring tool as disclosed above biases an upper piston upward, and similarly biases the lower piston upward. The upper release mechanism holds the upper hammer in a downward position and releases the upper hammer to produce an upward jarring force, and similarly the lower release mechanism holds the lower hammer in an initial downward position, and releases the lower hammer to produce an upward jarring force. Upward jarring forces are desirably used to release a stuck tool in a drilling application. In other applications, however, the hydraulic jarring tool may be used for producing a plurality of downward jarring forces. For these applications, the upper biasing member may bias the upper piston in an axially downward direction, and the lower biasing member may similarly bias the lower piston in an axially downward direction. The upper release member may hold the upper hammer in an upper position and release the upper hammer to produce a downward jarring force, and similarly the lower release mechanism may hold the lower hammer in an upper position and release the lower hammer to produce a downward jarring force. A hydraulic jarring tool of the present invention may be used with or without an enhancer.

In the FIG. 8 embodiment, if an enhancer is not utilized and jarring is upward, the upper jarring section will first release an upper hammer to strike the upper anvil, and the lower jarring section may thereafter release the lower hammer to strike the lower anvil and close the upper jar. Thereafter, the upper jar section may again release the upper hammer to strike the upper anvil. If an enhancer is not utilized and jarring is downward, the lowermost jarring section will first release a lower hammer to strike the lower anvil, and the uppermost jarring section may thereafter release the upper hammer to strike the upper anvil and close the upper jar. Thereafter, the lowermost jar section may again release the lower hammer to strike the lower anvil. The tool may be used in many applications for producing a plurality of upward jarring forces, but also may be used in a modified version to produce a plurality of downward jarring forces.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A hydraulic jarring tool for suspending in a well from a wireline or tubular string or drill string to release a tool stuck in the well, or for positioning along a drill string to release the drill string stuck in the well, the jarring tool comprising:

an upper jarring section including an upper housing supported on one of the wireline, the tubular string or the drill string;

an upper piston axially movable within the upper housing when tension is applied to the wireline, the tubular string or the drill string;

an upper biasing member for biasing the upper piston in a selected axial direction;

an upper fluid metering device for metering fluid within the upper housing axially past the upper piston;

an upper release mechanism for holding an upper hammer in an initial position and releasing the upper hammer to strike an upper anvil in response to movement of the upper piston to produce an axial jarring force;

a lower jarring section including a lower housing supported on the one of the wireline, the tubular string or the drill string below the upper jarring section;

a lower piston axially movable within the lower housing when tension is applied to the wireline, the tubular string or the drill string;

a lower biasing member for biasing the lower piston in a selected axial direction;

a lower fluid metering device for metering fluid within the lower housing axially past the lower piston;

a lower release mechanism for holding a lower hammer in an initial position and releasing the lower hammer to strike a lower anvil in response to movement of the lower piston to produce an axial jarring force in the same direction as the force produced by the upper release mechanism;

a timing mechanism for releasing one of the upper and lower hammers subsequent to releasing the other of the upper and lower hammers, thereby resulting in a timed delay between the impact of one hammer striking the respective anvil and an impact of the other hammer striking the respective anvil; and a selector switch for selecting a number of times fluid is metered past one of the upper and lower pistons prior to increasing flow past the respective metering device and thereby reducing metering time.

2. A hydraulic jarring tool as defined in claim 1, wherein the timing mechanism includes the upper fluid metering device metering fluid at a different rate than the lower fluid metering device.

3. A hydraulic jarring tool as defined in claim 1, wherein the timing mechanism includes the upper release mechanism having a different travel length than the lower release mechanism before releasing the respective hammer, such that one hammer is released prior to the other hammer.

4. A hydraulic jarring tool as defined in claim 1, wherein the selector switch is activated each time a respective one of the upper and lower jarring sections is activated, thereby providing a visual indication that a jarring section has been activated.

5. A hydraulic jarring tool as defined in claim 1, further comprising:

a mandrel extending axially through each of the upper and lower housings, each hammer being secured to a respective mandrel.

6. A hydraulic jarring tool as defined in claim 5, further comprising:

a collet mechanism for holding each housing in a downward position and releasing each housing in response to movement of the respective piston.

7. A hydraulic jarring tool as defined in claim 1, further comprising:

a flow path fluidly in parallel with each fluid metering device; and a check valve in the flow path for passing fluid from above the piston to below the piston while resetting the respective jarring section and for closing to prevent fluid from passing upward through the flow path.

8. A hydraulic jarring tool as defined in claim 1, wherein each fluid metering device passes fluid from a lower portion of the respective housing past the respective piston and to an upper portion of the respective housing.

9. A hydraulic jarring tool as defined in claim 1, wherein the upper jarring section releases the upper hammer to strike the upper anvil, the lower jarring section thereafter releases the lower hammer to strike the lower anvil and close the upper jar, and thereafter the upper jarring section again releases the upper hammer to strike the upper anvil.

10. A hydraulic jarring tool for suspending in a well from a wireline or tubular string or drill string to release a tool stuck in the well, or for positioning along a drill string to release the drill string stuck in the well, the jarring tool comprising:

an upper jarring section including an upper housing supported on one of the wireline, the tubular string or the drill string;

an upper piston axially movable within the upper housing when tension is applied to the wireline, the tubular string or the drill string;

an upper biasing member for biasing the upper piston upward;

an upper fluid metering device for metering fluid within the upper housing axially past the upper piston; and an upper release mechanism for holding an upper hammer in a downward position and releasing the upper hammer to strike an upper anvil in response to movement of the upper piston to produce an upward jarring force;

a lower jarring section including a lower housing supported on one of the wireline, the tubular string or the drill string;

a lower piston axially movable within the lower housing when tension is applied to the wireline, the tubular string or the drill string;

a lower biasing member for biasing the lower piston upward;

a lower fluid metering device for metering fluid within the lower housing axially past the lower piston;

a lower release mechanism for holding a lower hammer in a downward position and releasing the lower hammer to strike a lower anvil in response to movement of the lower piston to produce an upward jarring force;

a selector switch for selecting a number of times fluid is metered past one of the upper and lower pistons prior to increasing flow past the respective metering device;

an enhancer for pulling upward on the tool or drill string stuck in the well, the enhancer including one or more springs loaded by tension in the wireline, the tubular string or the drill string and released to exert an upward force; and a timing mechanism for releasing one of the upper and lower hammers subsequent to releasing the other of the upper and lower hammers, thereby resulting in a timed delay between the impact of one hammer striking the respective anvil and an impact of the other hammer striking the respective anvil.

11. A hydraulic jarring tool as defined in claim 10, wherein the timing mechanism includes the upper fluid metering device metering fluid at a different rate than the lower fluid metering device.

12. A hydraulic jarring tool as defined in claim 10, wherein the timing mechanism includes the upper release mechanism having a different travel length than the lower release mechanism before releasing the respective hammer, such that one hammer is released prior to the other hammer.

13. A hydraulic jarring tool as defined in claim 10, wherein the selector switch is activated each time a respective one of the upper and lower jarring sections is activated, thereby providing a visual indication that a jarring section has been activated.

14. A hydraulic jarring tool as defined in claim 10, wherein the upper jarring section is provided above the enhancer, and the lower jarring section is provided below the enhancer.

15. A hydraulic jarring tool as defined in claim 10, wherein both the upper jarring section and the lower jarring sections are provided below the enhancer.

16. A hydraulic jarring tool as defined in claim 10, further comprising:

a mandrel extending axially through each of the upper and lower housings, each hammer being secured to a respective mandrel; and a collet mechanism for holding each housing in a downward position and releasing each housing in response to movement of the respective piston.

17. A hydraulic jarring tool as defined in claim 10, wherein the upper jarring section releases the upper hammer to strike the upper anvil, the lower jarring section thereafter releases the lower hammer to strike the lower anvil and close the upper jar, and thereafter the upper jarring section again releases the upper hammer to strike the upper anvil.

18. A method of actuating a hydraulic jarring tool suspended in a well from a wireline or tubular string or drill string to release a tool stuck in the well, or for positioning along a drill string to release the drill string stuck in the well, the method comprising:

supporting an upper jarring section including an upper housing on the wireline, the tubular string or the drill string;

providing an upper piston axially movable within the upper housing when tension is applied to the wireline, the tubular string or the drill string;

biasing the upper piston in an axial direction;

metering fluid within the upper housing axially past the upper piston;

providing an upper release mechanism for holding an upper hammer in an initial position and releasing the upper hammer to strike an upper anvil in response to movement of the upper piston to produce an axial jarring force;

supporting a lower jarring section including a lower housing on the wireline, the tubular string or the drill string;

providing a lower piston axially movable within the lower housing when tension is applied to the wireline, the tubular string or the drill string;

biasing the lower piston in an axial direction;

metering fluid within the lower housing axially past the lower piston;

providing a lower release mechanism for holding a lower hammer in an initial position and releasing the lower hammer to strike a lower anvil in response to movement of the lower piston to produce an axial jarring force in the same direction as the force produced by the upper release mechanism;

releasing one of the upper and lower hammers subsequent to releasing the other of the upper and lower hammers, thereby resulting in a timed delay between the impact of one hammer striking the respective anvil and an impact of the other hammer striking the respective anvil; and the upper jarring section releases the upper hammer to strike the upper anvil, the lower jarring section thereafter releases the lower hammer to strike the lower anvil and close the upper jar, and thereafter the upper jarring section again releases the upper hammer to strike the upper anvil.

19. A method defined in claim 18, wherein releasing one of the upper and lower hammers includes metering fluid at different rates past the upper and lower pistons.

20. A method as defined in claim 18, wherein releasing one of the upper and lower hammers includes providing a different travel length for the upper and lower release mechanisms before releasing the respective hammer, such that one hammer is released prior to the other hammer.

21. A method as defined in claim 18, further comprising:

providing a selector switch for selecting a number of times fluid is metered past one of the upper and lower pistons prior to increasing flow past the respective piston.

22. A method as defined in claim 18, further comprising:

activating the selector switch each time a respective one of the upper and lower jarring sections is activated, thereby providing a visual indication that a jarring section has been activated.

23. A method as defined in claim 18, further comprising:

providing an enhancer for pulling upward on the tool or drill string stuck in the well, the enhancer including one or more springs loaded by tension in the wireline, the tubular string or the drill string and released to exert an upward force.

24. A method as defined in claim 18, further comprising:

providing a mandrel extending axially through each of the upper and lower housings, each hammer being secured to a respective mandrel; and providing a collet mechanism for holding each housing in a downward position and releasing each housing in response to movement of the respective piston.

25. A method as defined in claim 18, further comprising:

providing a flow path fluidly in parallel with each fluid metering device; and providing a check valve in the flow path for passing fluid from above the piston to below the piston while resetting the respective jarring section and for closing to prevent fluid from passing upward through the flow path.

26. A method as defined in claim 18, wherein release of each housing produces an axially upward jarring force.

27. A hydraulic jarring tool for suspending in a well from a wireline or tubular string or drill string to release a tool stuck in the well, or for positioning along a drill string to release the drill string stuck in the well, the jarring tool comprising:

a jarring section including a housing supported on one of the wireline, the tubular string or the drill string;

a piston axially movable within the housing when tension is applied to the wireline, the tubular string or the drill string;

a biasing member for biasing the piston in a selected axial direction;

a fluid metering device for metering fluid within the housing axially past the upper piston;

a release mechanism for holding a hammer in an initial position and releasing the hammer to strike a lower anvil in response to movement of the piston to produce an axial jarring force; and an enhancer for pulling upward on the jarring tool, the enhancer including one or more springs loaded by tension in the wireline, the tubular string or the drill string and released to exert an axial force.

28. A hydraulic jarring tool as defined in claim 27, further comprising:

a timing mechanism for selectively releasing the hammer.

29. A hydraulic jarring tool as defined in claim 28, wherein the timing mechanism includes a release mechanism for releasing the hammer.

30. A hydraulic jarring tool as defined in claim 28, further comprising:

a selector switch for selecting a number of times fluid is metered past the piston.

31. A hydraulic jarring tool as defined in claim 30, wherein the selector switch is activated each time the jarring section is activated, thereby providing a visual indication that the jarring section has been activated.

32. A hydraulic tool as defined in claim 27, further comprising:

a timing mechanism for selectively releasing the hammer.

33. A hydraulic jarring tool as defined in claim 27, wherein an upper jarring section is provided above the enhancer, and a lower jarring section is provided below the enhancer.

34. A hydraulic jarring tool as defined in claim 27, wherein both an upper jarring section and a lower jarring sections are provided below the enhancer.

35. A hydraulic jarring tool as defined in claim 27, wherein when the enhancer is loaded, an upper jarring section releases an upper hammer to strike the upper anvil, a lower jarring section thereafter releases a lower hammer to strike a lower anvil, and thereafter the enhancer is unloaded such that the upper jarring section again releases the upper hammer to strike the upper anvil, closing the enhancer.

36. A hydraulic jarring tool as defined in claim 27, wherein the upper jarring section is provided above the enhancer, and the lower jarring section is provided below the enhancer.

37. A hydraulic jarring tool as defined in claim 27, wherein both the upper jarring section and the lower jarring sections are provided below the enhancer.

38. A hydraulic jarring tool as defined in claim 37, wherein when the enhancer is loaded, the upper jarring section releases the upper hammer to strike the upper anvil, the lower jarring section thereafter releases the lower hammer to strike the lower anvil and close the upper jar, and thereafter the enhancer is unloaded such that the upper jarring section again releases the upper hammer to strike the upper anvil, closing the enhancer.

* * * * *